United States Patent [19]

Werbowy

[11] Patent Number: 4,620,860

[45] Date of Patent: Nov. 4, 1986

[54] PROCESS FOR MAKING GLASS FIBER PRODUCTS AND PRODUCT PRODUCED

[75] Inventor: Kenneth D. Werbowy, Islington, Canada

[73] Assignee: Manville Corporation, Denver, Colo.

[21] Appl. No.: 758,177

[22] Filed: Jul. 23, 1985

[51] Int. Cl.[4] ..... C03C 25/02; C03B 37/06

[52] U.S. Cl. ..... 65/3.4; 65/3.43; 65/4.4; 65/9; 156/62.6; 156/335; 427/389.8; 427/397.7

[58] Field of Search ..... 65/3.4, 3.43, 4.4, 9; 427/340, 341, 221, 389.8, 397.7; 156/62.6, 335

[56] References Cited

U.S. PATENT DOCUMENTS 3,144,376 8/1964 Plumberg et al. ..... 65/5
3,437,508 4/1969 Gorski ..... 65/3.4
3,616,179 10/1971 McCombs ..... 156/335 X
3,616,181 10/1971 Stalego ..... 65/4.4 X
3,846,225 11/1974 Stalego .
3,850,601 11/1974 Stapleford et al. ..... 65/4.4 X
4,014,726 3/1977 Fargo ..... 65/3.43 X

*Primary Examiner*—Robert Lindsay
*Attorney, Agent, or Firm*—John D. Lister; Cornelius P. Quinn; Gregory A. Evearitt

[57] ABSTRACT

A novel process for the production of glass fiber products is provided. By the inventive process glass fibers are combined with a heat curable binder and then consolidated onto a conveyor where a glass fiber mass is placed onto the surface of the consolidated mass of glass fibers and heat curable binder. The resulting product is then subsequently cured and then coated on-line with a suitable coating. Glass fiber products made by the novel inventive process are also disclosed.

7 Claims, No Drawings

PROCESS FOR MAKING GLASS FIBER PRODUCTS AND PRODUCT PRODUCED

This invention relates to a novel process for the manufacture of glass fiber products. It also relates to glass fiber products made by the novel process.

The use of glass fiber products for exterior insulating cladding, ceiling panels, acoustical wall panels, and duct liners is known in the building industry. Typically these products are made by first forming on an on-line process a substrate of glass fiber and heat cured binder. The produced substrate is then removed off-line and adhered with the use of a suitable adhesive to a plastic or vinyl material for protective and/or decorative purposes.

The typical, conventional process is not practiced without disadvantages, however. To begin with, the surface of the glass fiber substrate tends to become exposed to tearing and other actions which can cause surface deformations as the substrate is moved through the curing ovens during the curing process. The tearing and other deformations result from machinery which moves the rather surface vulnerable glass fiber substrate along in the oven.

Removing the cured glass fiber substrate off-line and then adhering it with the use of a glue to a facing material also has disadvantages. The use of an adhesive not only increases the cost of the final product but also provides a potential health and safety hazard because materials in the glue can combust and therefore release noxious substances into the surrounding environment. Furthermore, when the facing material is adhered to the glass fiber substrate off-line there are increased chances of so-called poor final product "registration." By the term poor "registration" is meant the fact that the facing material is not evenly and smoothly adhered to the glass fiber substrate and consequently is sometimes placed on top of the substrate at an improper angle relative to the substrate. This poor registration obviously results in an aesthetically unappealing final product as well as one that can have functional problems.

When the product is coated or laminated off-line even further problems arise. The coating or lamination rate can be difficult to control resulting in an uneven distribution of final products of varying coating or laminate thickness. Because a plastic or vinyl coating is typically applied, the final glass fiber product can have acoustical problems which is antithetical to its intended final use, e.g. as acoustical wall panels. The acoustical problems are due to the poor sound absorptions of plastics and vinyls because of their nonporous nature. Also a plastic or vinyl laminated product can tend to delaminate over time and this presents product aesthetic and maintenance problems.

Because of all the above problems and difficulties associated with the practice of the typical or conventional process for the production of glass fiber related products, there has existed a need in the industry for an improved process which obviates most or all of the above mentioned difficulties. Consquently, Applicant sought to devise or create such a relatively problem-free process.

As disclosed herein, Applicant has discovered a novel process for the production of glass fiber products which advantageously overcomes the difficulties and problems associated with prior art conventional processes.

Briefly, by Applicant's present invention glass fibers are combined with a heat curable binder and then consolidated onto a conveyor where a glass fiber mass is placed onto the surface of the consolidated mass of glass fibers and heat curable binder. The resulting product is then subsequently cured and then coated on-line with a suitable coating. The coated product may then be dried on or off-line, preferably on-line.

By practicing Applicant's inventive process, many problems are eliminated as well as new benefits created.

To begin with, placing a cured fiber glass mass onto the surface of the uncured glass mass fiber substrate in an on-line process before curing of the latter is achieved has definite benefits. The combination of cured glass fiber mass and uncured substrate will be easily adhered during the subsequent curing process. This eliminates the need for special adhesives and consequently lowers the final product cost as well as helps eliminate health and safety problems. Additionally, the fact that the two are oriented together on-line obviates the previously mentioned product registration difficulties. And the fact that the glass fiber substrate is surfaced with a relatively tougher cured glass fiber mass will prevent the occurrance of surface deformations to the product as it is moved on-line through the curing oven.

By Applicant's inventive process, the cured product as it emerges from the curing means is coated on-line with a suitable coating, typically a latex based paint. By coating the product on-line uniformity in the coating application from product to product is assured. Additionally, the use of a suitable coating, as defined later herein, results in good sound adsorption in the final prduct.

In the present invention, the glass fibers utilized can be those produced in any conventional or suitable manner or alternatively any of those which are commercially available can be used. The glass fibers are typically produced by flowing streams of fused materials through small orifices and then drawing out the streams at speeds capable of attenuating the materials into fibers of desired diameters.

Although any heat curable binder compatible with the glass fibers may be utilized in the present invention, the preferred one will contain a phenolic resin selected from the group consisting of phenol-formaldehyde partial condensation products and phenol-amino compound-formaldehyde condensation products, and is a phenolic resole. Such phenolic resoles are known to the art. In general, a phenolic resole is produced in the presence of a basic catalyst by reaction in an aqueous system of more than one mole of formaldehyde per mole of phenol. Phenol-amino compound-formaldehyde condensation products can be produced by an aqueous alkaline condensation of phenol and formaldehyde to produce a mixture consisting essentially of phenol alcohols, adjustment of this phenol alcohol mixture to a pH at which further condensation of the phenol and formaldehyde is minimized and then adding melamine or another amino-resin-former. The resulting reaction mixture can be heated to condense the melamine or other amino compound with the phenol alcohols and any unreacted formaldehyde. Condensation, particularly when the amino compound is urea or dicyandiamide, occurs under ambient conditions so that the heating step can be omitted when these amino compounds are used or, in any event, heating can be employed to cause an appreciable condensation of the melamine or other amino compound.

In most instances, and preferably so, formaldehyde and phenol are used, although any aldehyde and phenol producing a hardenable phenolic resole-type partial condensation product can be used. Aldehydes which can be used for replacement of the formaldehyde, in whole or part, include: paraformaldehyde, furfural, acetaldehyde, metaldehyde, tetraldehyde and the like. Phenols which can be used for replacement of the hydroxy benzene in whole or in part include: various cresols, xylenols, resorcinol, and the like. While melamine is frequently used as the amino-resin-former reactant, urea, thiourea, dicyandiamide and other like amino compounds capable of condensation with phenol alcohols and formaldehyde also can be used in place of part or all of the melamine.

Also a silane coupling agent may be present in the binder. It is thought that any commercially available silane coupling agent may be used. However, the preferred silanes are aminoalkylsilanes. Certain epoxy silanes may also be utilized.

A catalyst may also be used in the binder system in the present invention. Such a catalyst is one which is effective during curing conditions to change the pH of the system to one at which condensation occurs at a relatively rapid rate. Typically, in a phenolic-resole system there is utilized an ammonium sulfate catalyst which under resin curing conditions releases ammonia gas from the system thereby decreasing the overall pH thereof.

A suitable dedusting agent may optionally be employed in the binder formulation. For the purpose of the present invention, a suitable dedusting agent is one which functions to prevent fiber ends or so-called "fiber dust" from flying off into the air during the production process. Such fiber ends or dust can pose a health hazard. Typically the dedusting agent will be a neat or emulsified viscous hydrocarbon type oil. In instances where dust suppression is of extreme importance a dedusting agent must be selected which continues to perform after the additional curing step. High temperature resistant dimethyl silicone fluids, such as General Electric SM2068, have been found to be useful.

Other adjuvants such as various fillers, pigments, and dyes can be used if desired, but such are not essential for the binder to be effective.

Preferably, the binder composition is applied to the glass fibers in such a way that the binder comprises from about 1.0 to 20 wt % of the total weight of the glass fiber products.

The binder and fibers are combined in any suitable manner. Typically, the binder is associated with the glass fibers in a forming hood and then they are projected onto a conveyor, preferably a foraminous conveyor, immediately after emerging from the forming hood.

Subsequently, a cured glass fiber mass have a uniform thickness in the range of about 10–30 mils, preferably about 30 mils, is placed on-line onto the surface of the thus consolidated mass of glass fibers and heat curable binder. The cured glass fiber mass will typically be a glass fiber mat of the appropriate thickness as will be known to those skilled in the art. Whatever cured glass fiber mass is used in the present invention should be placed onto the surface of the substrate in such a manner so as to ensure good so-called registration of the final product as explained herein earlier.

The resulting product is then conveyed to a curing means, preferably an oven. Curing of the resulting product is then conducted under conditions of time and temperature sufficient to effect adhesion between the glass fiber mat and the consolidated mass of glass fibers. Preferably, curing will be conducted at a temperature in the range of about 500°–550° F. for about 1–6 minutes, most preferably at about 550° F. for about 2–3 minutes.

After proper curing of the product is achieved, it is conveyed to an on-line coating means, preferably a knife coating apparatus, where a suitable coating is applied to the surface of the product. As used herein, a suitable coating is defined to be one which has some degree of porosity so as to achieve sound absorption by the final product thereby resulting in good acoustical properties. Generally, such a coating will be a paint, preferably a latex based paint such as a latex acrylic with non-bridging characteristics.

The coating should be applied in such a manner to the surface of the product so as to achieve a uniform thickness of the coating on the final product.

Preferably the coated product will then be conveyed to a drying means (preferably an oven) and then dried on-line under conditions of time and temperature sufficient to effect complete drying of the product. Preferably, the coated product will be dried at a temperature of about 400°–500° for about 0.5–2 minutes. Alternatively, the coated product can be removed off-line and allowed to dry at room temperature or other ambient temperature conditions.

The thus formed product results in a rigid structure of sound integrity and pleasing aesthetics which can have a variety of uses including, but not limited to, the following: ceiling panels, acoustical wall panels, and duct liners.

Reasonable variations and modifications of the foregoing are possible without departing from the spirit or scope of the present invention.

I claim:

1. A process for the production of glass fiber products comprising the steps of:

(a) combining glass fibers with a heat curable binder composition;

(b) consolidating the glass fibers and heat curable binder onto a conveyor;

(c) placing a cured glass fiber mass having a uniform thickness in the range of about 10–20 mils onto the surface of the thus consolidated mass of fibers and heat curable binder;

(d) conveying the resulting product of (c) above to a curing means;

(e) curing the resulting product of (d) at a temperature in the range of about 500°–550° F. for about 1–6 minutes;

(f) conveying the product of (e) to a knife coating means; and (g) thereafter applying a paint coating to the surface of the resulting product of (e).

2. A process according to claim 1 wherein the coated product resulting from 1(g) is dried on-line.

3. A process according to claim 1 wherein said glass fibers in 1(a) are formed from molten streams of glass.

4. A process according to claim 1 wherein said heat curable binder in 1(a) is a phenolic resin.

5. A process according to claim 1 wherein said curing means in 1(d) is an oven.

6. A process according to claim 1 wherein said coating in 1(g) is a latex based paint.

7. The product formed by the method as claimed in claim 1.

* * * * *